United States Patent [19]

Niimi et al.

[11] 4,133,241

[45] Jan. 9, 1979

[54] ELECTRONIC MUSICAL INSTRUMENT UTILIZING RECURSIVE ALGORITHM

[75] Inventors: Koji Niimi, Hamamatsu; Michiaki Kumaoka, Shizuoka; Takashi Yamada, Hamamatsu, all of Japan

[73] Assignee: Nippon Gakki Seizo Kabushiki Kaisha, Hamamatsu, Japan

[21] Appl. No.: 689,867

[22] Filed: May 25, 1976

[30] Foreign Application Priority Data

| | | | |
|---|---|---|---|
| May 27, 1975 | [JP] | Japan | 50-63217 |
| May 27, 1975 | [JP] | Japan | 50-63218 |
| May 27, 1975 | [JP] | Japan | 50-63219 |
| May 27, 1975 | [JP] | Japan | 50-63220 |

[51] Int. Cl.[2] ..... G10H 1/00

[52] U.S. Cl. ..... 84/1.01; 84/1.12; 84/1.22; 364/718

[58] Field of Search ..... 84/1.01, 1.03, 1.12, 84/1.24, 1.19, 1.22; 340/172.5, 347 DA; 235/152, 156, 197; 328/157, 181, 185, 186; 364/700, 708, 718, 851

[56] References Cited

U.S. PATENT DOCUMENTS

| | | | |
|---|---|---|---|
| 3,305,675 | 2/1967 | Haase | 84/1.23 |
| 3,610,799 | 10/1971 | Watson | 84/1.01 |
| 3,689,914 | 9/1972 | Butler | 540/547 DA |
| 3,698,631 | 10/1972 | Drechsler | 235/152 |
| 3,809,780 | 5/1974 | Deutsch | 84/1.01 |
| 3,821,714 | 6/1974 | Tomisawa et al. | 340/172.5 |
| 3,823,390 | 7/1974 | Tomisawa et al | 340/172.5 |
| 3,899,951 | 8/1975 | Griffith et al. | 84/1.01 |
| 3,910,150 | 10/1975 | Deutsch et al. | 84/1.03 |
| 3,972,259 | 8/1976 | Deutsch | 84/1.24 |

OTHER PUBLICATIONS

Relinor, Lawrence; Bernard Gold, *Theory & Application of Digital Signal Processing;* 5/1975, pp. 563–565.

*Primary Examiner*—Robert K. Schaefer
*Assistant Examiner*—Vit W. Miska
*Attorney, Agent, or Firm*—Cushman, Darby & Cushman

[57] ABSTRACT

Musical tone signals are produced in an electronic musical instrument by calculating the amplitudes at successive sample points of a complex waveshape and by delivering these calculated amplitudes one after another in time sequence. A recursive algorithm is implemented to calculate each amplitude, using one or more sets of parameters and also the calculated amplitudes for a plurality of the preceding sample points. This musical instrument can produce a variety of musical sounds which realistically simulate those of the various existing natural musical instruments including percussion instruments, simply by suitably determining the parameters.

28 Claims, 17 Drawing Figures

CALCULATOR
40
42
Σ
MEMORY
30
$a_k$
$a_{k-1}$
$a_{k-2}$
$a_1$
$41_k$
$41_{k-1}$
$41_{k-2}$
$41_1$
SHIFT REGISTER
60
$61_k$
$61_{k-1}$
$61_{k-2}$
$61_1$
REG.
BUFFER REGISTER
50
CK
SWITCH-OVER CKT.
70
$71_k$
$71_{k-1}$
$71_{k-2}$
$71_2$
$71_1$
ST
MEMORY
80
F(0T)
F(1T)
F(2T)
F{(k-2)T}
F{(k-1)T}
D/A CONV.
90
SECOND SYSTEM
100
ADDRESS CONTROL
20
KEYBOARD SWITCH CKT.
10

ELECTRONIC MUSICAL INSTRUMENT UTILIZING RECURSIVE ALGORITHM

BACKGROUND OF THE INVENTION (a) Field of the Invention

The present invention relates to an electronic musical instrument wherein tones are produced by computing the amplitudes, at successive sample points, of a complex waveshape and aligning these amplitudes one after another in time sequence to form musical tone waves as the computations are carried out.

(b) Brief Description of the Prior Art

In U.S. Pat. No. 3,809,786 entitled COMPUTOR ORGAN is disclosed an electronic musical instrument wherein the amplitudes at successive sample points of a musical waveshape are computed, and the amplitudes are aligned in time sequence to form musical tone waves as the computations are carried out. In the musical instrument, a discrete Fourier algorithm is implemented to calculate the individual harmonic components at each sample point, using a stored set of harmonic coefficients which characterize the resultant waveshape. For each sample point, the amplitudes of plural harmonic components are calculated individually by multiplying the coefficient associated with each harmonic by a sine value related to the sample point which value is read out of a sinusoidal table memory.

Such a prior art instrument needs several large capacity memories for storing the harmonic coefficients and the sinusoidal table in order to attain a realistic simulation of existing instrument sounds such as of an air-driven organ pipe, piano, flute, horn, or string, and it also needs a complex means for programatically scaling the harmonic coefficients with the lapse of time to obtain the attack, decay and other amplitude transient effects.

SUMMARY OF THE INVENTION

An object of the present invention is to provide an electronic musical instrument wherein waveshape computations are accomplished in a manner different from that known in the prior art, yet exhibiting all of the advantages of digital waveshape generation as obtained in the prior art.

Another object of the present invention is to provide an electronic musical instrument of the type described, which is capable of generating a musical waveshape which realistically simulates the sound of existing musical instruments.

Still another object of the present invention is to provide an electronic musical instrument of the type described, which is capable of generating a musical waveshape including the components at frequencies which are inharmonically related to the fundamental frequency in addition to the components at the fundamental and other generally harmonically related frequencies.

Yet another object of the present invention is to provide an electronic musical instrument of the type described, which is able to provide the attack, decay and other note amplitude transient effects without the provision of a complex means.

A further object of the present invention is to provide an electronic musical instrument of the type described, which can provide the so-called touch-response and after-control effects of the produced tones.

Still further object of the present invention is to provide an electronic musical instrument of the type described, which is simple in arrangement.

In accordance with the present invention, the sample point amplitudes of a complex waveshape are computed at regular time intervals, and the amplitudes are sequentially delivered one after another to form musical sounds as the computations are carried out. A recursive algorithm is implemented to calculate the waveshape amplitude at each sample point, using a stored set of waveshape amplitudes at a plutality of the preceding sample points.

These and other objects as well as the features of the present invention will become apparent by reading the following detailed description when taken in conjunction with the accompanying drawings.

DETAILED DESCRIPTION OF THE PREFERRED EMBODIMENTS

Figure 1:
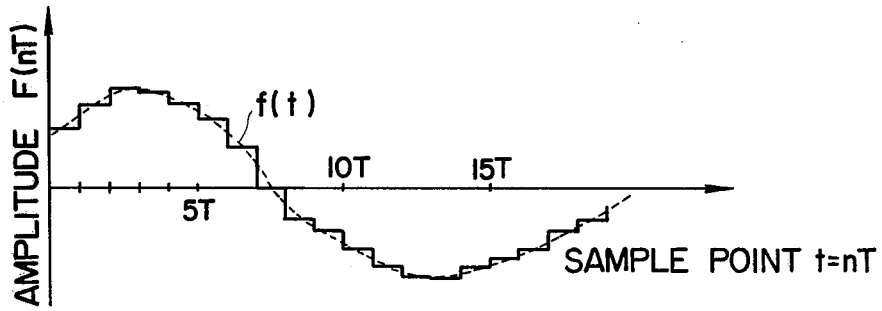
FIG. 1 is a chart for explaining the method of digitally synthesizing a complex waveshape.

Referring now to FIG. 1, the principle of the present invention will be described. A musical waveshape f(t) which is a function of time t is produced by computing the amplitude F(nT) at successive sample points, and aligning these amplitudes in time sequence to form musical sounds as the computations are carried out. The amplitude computations are performed at regular time intervals T, as plotted along the abscissa of FIG. 1, which are constant regardless of the fundamental frequency of the note to be produced.

According to the present invention, the waveshape amplitude F(nT) at each sample point nT is computed in accordance with the following recursion equation:

$$F(nT) = \sum_k a_k F[(n-k)T] \quad \text{(Eq. 1)}$$

where n represents integers designating the successive sample points; F[(n−k)T] represents the amplitudes at the preceding sample point (n−k)T; k represents plural different integers other than zero; and $a_K$ represents weighting coefficients for F[(n−k)T]. If k=1, 2, . . ., K−1, K for instance, Eq. 1 is represented as follows:

$$\begin{aligned} F(nT) &= \sum_{k=1}^{K} a_k F[(n-k)T] \quad \text{(Eq. 2)} \\ &= a_1 F[(n-1)T] + a_2 F[(n-2)T + \ldots \\ &\quad + a_{K-1} F[(n-K+1)T] + a_K F[(n-K)T] \end{aligned}$$

By the calculation method of Eq. 1, there can be obtained the following types of musical waveshapes.

(1) $f(t) = A \cdot \epsilon^{\alpha t} \cdot \alpha \mathrm{Sin}(\omega t + \theta)$ (2) $f(t) = B \cdot Y^t$ (3) $f(t) = C \cdot t^j \cdot y$ (4) composite waveshape of two or more among (1), (2) and (3)

Where, A, B, C and $\theta$ are constants each dependent upon the initial conditions which are set for starting the calculation of the sample point amplitudes of a required musical waveshape according to Eq. 1; and $\alpha$, $\omega$, $y$ and $j$ are constants each dependent upon the weighting coefficients $a_k$ which are set correspondingly to the required musical waveshape. As such, it is possible, according to the present invention, to produce various complex waveshapes whose amplitudes and frequencies are changed in complex manners with respect to time without providing any means for programatically scaling the coefficients $a_k$ with the lapse of time, and as a result it is possible to obtain a musical sound realistically simulating that of the existing musical instruments including a flute, horn, air-driven organ pipe, piano and strings. It should be noted, moreover, that there can be produced a musical waveshape containing waveshape components at frequencies which are inharmonically related to the fundamental frequency of this musical waveshape. This means that even those musical sounds of the existing percusion instruments such as a drum, bell, cymbal and so on can be synthesized according to the present invention. Furthermore, according to the present invention, the required attack, decay and other musical tone amplitude- and pitch-transient characteristics can be obtained by setting suitably the initial conditions and the weighting coefficients, and the so-called touch-response and after-control effects may be obtained simply by determining the initial conditions and the weighting coefficients $a_k$ in accordance with the touch speed onto the key and the depressing pressure of the key. Needless to say, the $k$ may be determined as skip-wise integers such as 2, 3, 5, . . ., or 1, 5, 4, . . ., etc.

Description will hereunder be made on the embodiments of the present invention.

Figure 2:
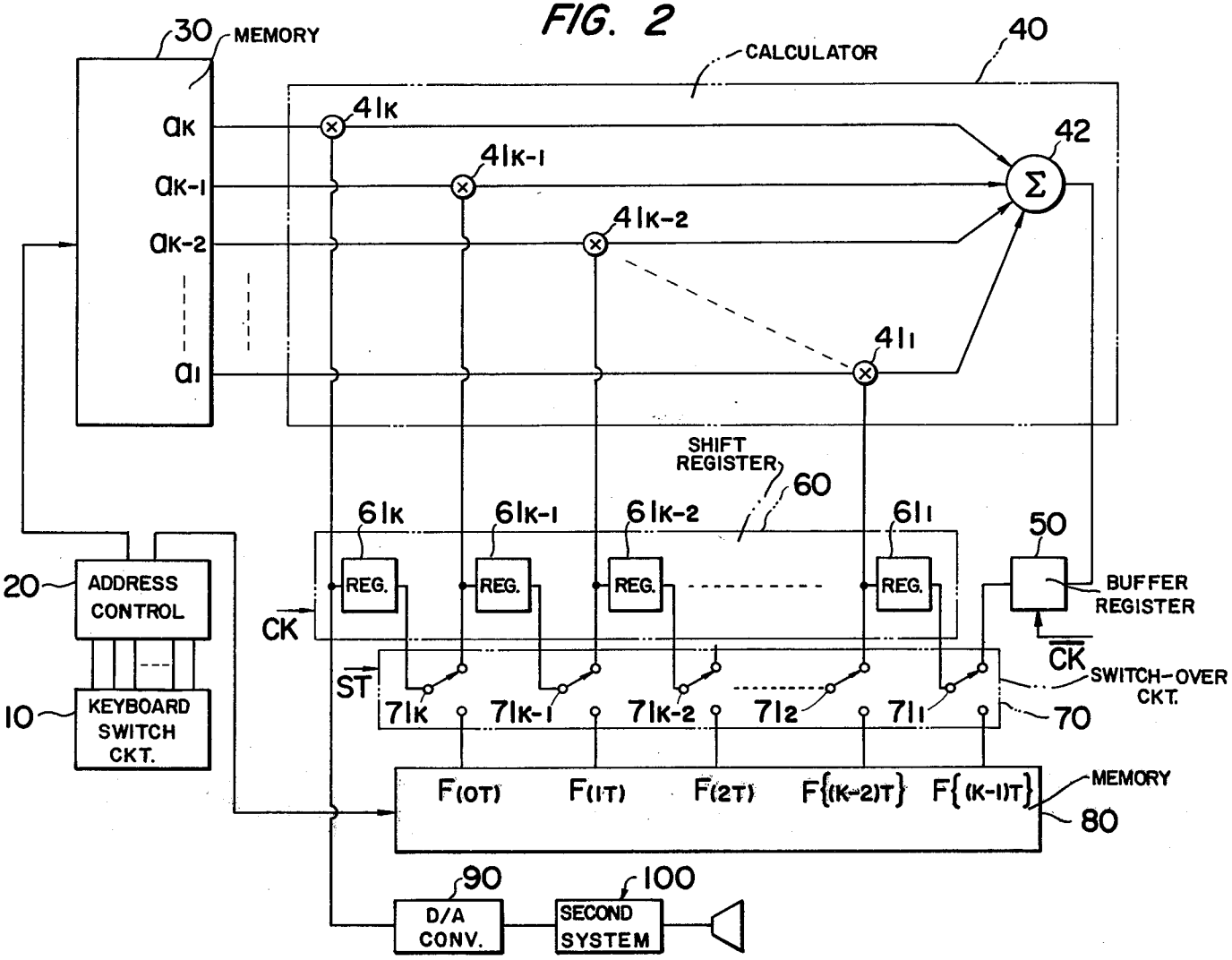
FIG. 2 is a block diagram showing an example of a musical instrument according to one aspect of the present invention.

FIG. 2 shows a principal example of an electronic musical instrument according to the present invention. The instrument comprises: a keyboard switch circuit 10; an address controller 20; a memory 30 storing, at individual locations thereof, the weighting coefficients $a_k$, a calculator 40 for calculating the amplitudes F(nT) at the successive sample points nT; a buffer register 50; a shift register 60 for storing the resultant amplitudes F[(n−k)T] produced by the calculator 40 at the preceding sample points (n−k)T; a switch-over circuit 70; a memory 80 storing the initial conditions; a digital-to-analog converter 90; and a sound system 100 including an audio amplifier and a speaker. The instrument operates to produce, via the sound system 100, a musical tone selected by actuating one of the keyboard switches 10.

Let us assume here that K=1, 2, 3, . . ., K. When one of the key switches 10 is closed, the address controller 20 accesses and reads out from the memory 30 a set of the weighting coefficients $a_1$, $a_2$, . . ., $a_K$ corresponding to the closed keyboard switch, and these read-out coefficients $a_1$, $a_2$, . . ., $a_K$ for that switch are applied to the calculator 40 for calculation of the waveshape amplitudes at the successive sample points. At the same time, the change-over circuit is initiated by a start pulse ST shown in FIG. 3, which is generated by a timing circuit not shown. Upon receipt of the start pulse ST, the respective switches $\mathbf{71}_1$, $\mathbf{71}_2$, . . ., $\mathbf{71}_K$ operate during the period of time T/2 to connect the shift register 60 to the initial condition memory 80. The initial conditions F(0T), F(1T), F(2T), . . ., F[(K−1)T], all corresponding to the closed keyboard switch, are accessed from the memory 80 under control of the address controller 20 and then placed from the memory 80 into the respective registers $\mathbf{61}_1$, $\mathbf{61}_2$, . . ., $\mathbf{61}_K$ constituting the shift register 60. The initial condition F(0T) is delivered out from the register $\mathbf{61}_K$ to the digital-to-analog converter 90, as the amplitude for the sample point oT. The calculator 40 includes multipliers $\mathbf{41}_1$, $\mathbf{41}_2$, . . ., $\mathbf{41}_K$ and an adder 42. The contents F[K−1)T] ~ F(0T) of the respective registers $\mathbf{61}_1$ ~ $\mathbf{61}_K$ are multiplied at the multipliers $\mathbf{41}_1$ ~ $\mathbf{41}_K$ by the weighting coefficients $a_1$ ~ $a_K$, respectively, and the resultant products $a_1 \cdot F[K-1)T]$, $a_2 \cdot F[K-2)T]$, . . ., $a_K \cdot F(0T)$ are algebraically summed by the adder 42 to obtain a new amplitude F[(K+1)T] which, in turn, is placed into the buffer register 50 at each pulse of the clock CK shown in FIG. 3.

Figure 3:
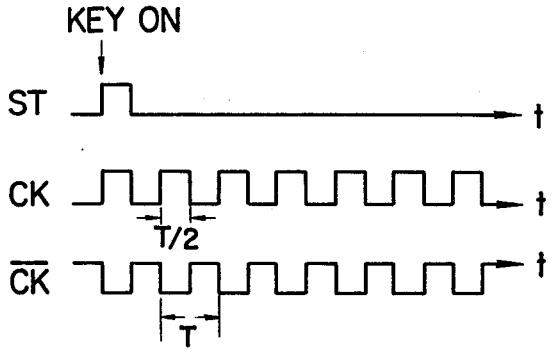
FIG. 3 is a timing diagram associated with the musical instrument of FIG. 2.

When the second pulse of the clock CK shown in FIG. 3 is generated by the timing circuit not shown, the contents of the respective registers $\mathbf{61}_1$ ~ $\mathbf{61}_K$ are shifted one position to the left and the content of the buffer register 50 is placed into the register $\mathbf{61}_1$. Thus, the content F(1T) of the register $\mathbf{61}_K$ is applied, as the amplitude at the sample point 1T, to the digital-to-analog converter 90. At the same time, the amplitude F[(n+2)T] is calculated by the calculator 40, using the contents F(1T), F(2T), . . ., F(KT), F[(K+1)T] and the weighting coefficients $a_1$ ~ $a_K$ to be placed into the buffer register 50 at the second pulse of clock CK.

By such routine, the amplitudes in digial form for successive sample points 0T, 1T, . . ., KT, (K+1)T, . . ., are applied to, synchronizingly of clock CK, to the digital-to-analog converter 90 to be converted to an analog voltage as the input to the sound system 100 so that a musical sound or tone corresponding to the closed keyboard switch 10 is reproduced by the sound system 100.

Needless to say, as the input to the digital-to-analog converter 90, there may be used any one of the contents of the respective registers $61_1$, $61_2$, . . ., $61_K$ and 50. For instance, if the content of the buffer register 50 is taken as the input of the digital-to-analog converter 90, the amplitudes for all sample points 0T, 1T, 2T, . . . are calculated by the calculator 40.

Figure 4A:
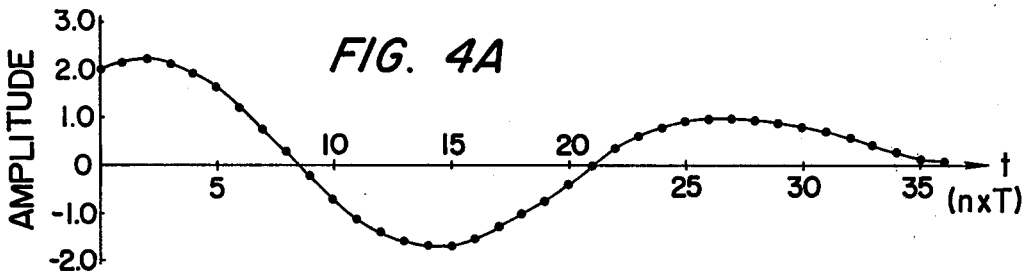
FIG. 4A is a chart showing an example of a musical waveshape generated by the musical instrument of FIG. 2.
Figure 4B:
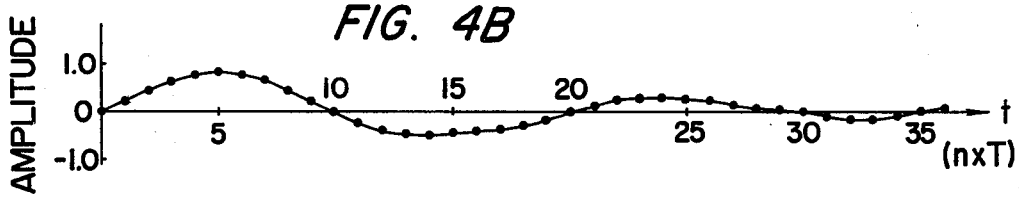
FIGS. 4B and 4C are charts showing the constituent waveshapes of the waveshape shown in FIG. 4A, respectively.
Figure 4C:
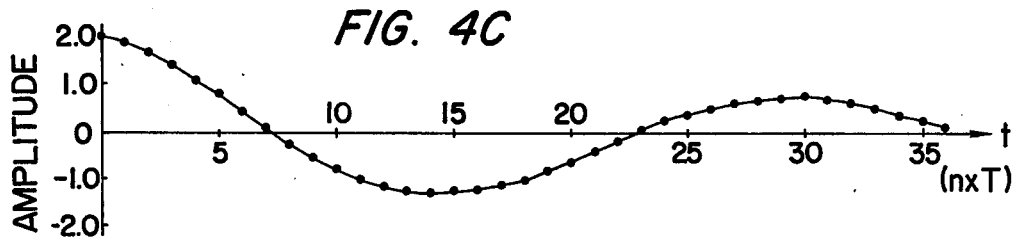

In FIG. 4A is shown a waveshape produced by the musical instrument of FIG. 2 under the conditions of: K=1, 2, 3 and 4; $a_1=3.701$, $a_2=-5.264$, $a_3=3.405$, $a_4=-0.846$; F(0T)=2.0, F(1T)=2.186, F(2T)=2.241, F(3T)=2.160. It can be understood that the waveshape of FIG. 4A is the composite of two waveshapes of FIGS. 4B and 4C each being waveshape of type (1) having different $\omega$, respectively.

Figure 5:
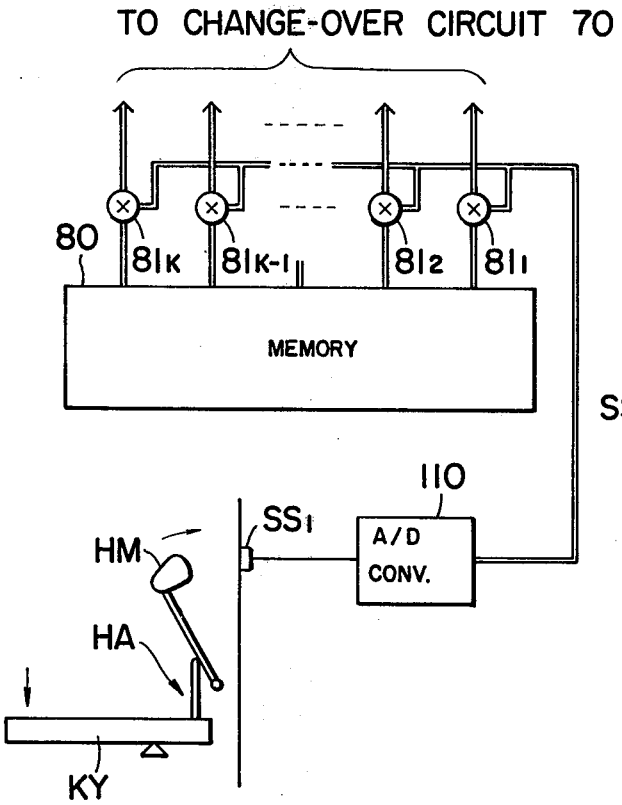
FIG. 5 is a block diagram showing an example of an arrangement for establishing the touch-response effect of the musical tone generated by the musical instrument of FIG. 2.
Figure 6:
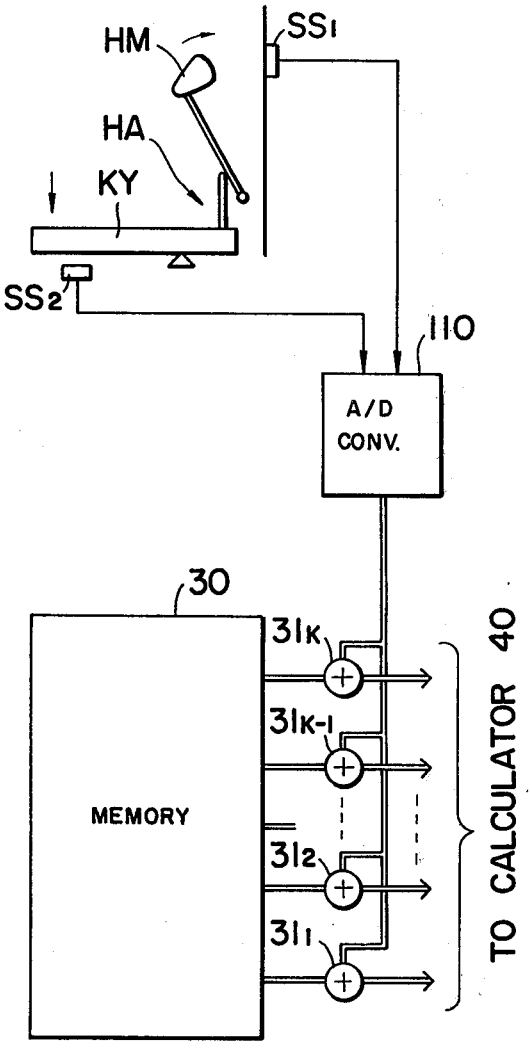
FIG. 6 is a block diagram showing an example of an arrangement for establishing both the touch-response and after-control effects of the musical tone generated by the musical instrument of FIG. 2.

As described previously, the so-called touch-response and after-control effects of the note produced by the musical instrument of the present invention are obtained by determining or varying the weighting coefficients $a_k$ and the initial conditions to be set for the calculation of the successive sample point amplitudes, in accordance with the touch speed or pressure onto the keys or pedals of the musical instrument. FIGS. 5 and 6 show an example of the arrangement for providing such effects, respectively.

In FIG. 5, the striking velocity of a hammer HM of a hammer action mechanism HA which is driven by the depressing movement of the key KY is detected by a sensor SS1, the output of which sensor being converted by an analog-to-digital converter 110 to a digital signal as the input of multipliers $81_1$, $81_2$, . . ., $81_K$. The initial conditions F[(K−1)T], F[(K−2)T], . . ., F(0T) are multiplied at the multipliers $81_1$–$81_K$ by the signal from the analog-to-digital converter 110 and then applied to the registers $61_1$–$61_K$ via the switches $71_1$–$71_K$. That is, the initial conditions are modulated of the amplitude in response to the touch speed of the key KY, prior to being placed into the shift register 60. With this arrangement, therefore, it is possible to obtain the touch-response effect.

In FIG. 6, there is provided another sensor SS2 for detecting the key depression pressure. The output of these sensors SS1 and SS2 are both converted by the analog-to-digital converter 110 to a digital signal as the input of multipliers $31_1$–$31_K$. The weighting coefficients $a_1$–$a_K$ are multiplied at the multipliers $31_1$–$31_K$ by the signal from the analog-to-digital converter 110, and then fed to the calculator 40. That is, the weighting coefficients $a_1$–$a_K$ are varied in accordance with the touch speed and pressure onto the key which is depressed by a player's finger. Therefore, the touch-response effect as well as the after-control effect are obtaiend by the arrangement of FIG. 6.

In accordance with another aspect of the present invention, the successive sample point amplitudes of an aimed complex waveshape are obtained by computing the amplitudes of each of plural partials constituting the waveshape, at each sample point of the waveshape, and by algebraically summing the computed amplitudes of the partials to obtain the complex amplitudes at the sample point of said aimed waveshape. The calculation of the respective amplitudes of the partials is carried out according to a recursive algorithm using a plurality of amplitudes of the corresponding partials at the preceding sample points. According to this aspect, it is possible to determine the frequencies and amplitudes of the respective partials independently of each other.

Let us now assume that an aimed waveshape consists of partials of M number and that for the calculation of each partial amplitude at successive sample points are used the amplitudes of respective partials at the nearest preceding two sample points. Under such conditions, the amplitude $f_m(nT)$ of the m-th partial at a sample point nT is calculated in accordance with the following equation:

$$f_m(nT) = p_m \cdot f_m[(n-1)T] + q_m \cdot f_m[(n-2)t],$$

$$\text{for } m=1, 2, \ldots, M \qquad \text{(Eq. 3)}$$

Accordingly, the complex amplitude F(nT) of the waveshape is as follows:

$$F(nT) = \sum_{m=1}^{M} f_m(nT) \qquad \text{(Eq. 4)}$$

$$= \sum_{m=1}^{M} \{ p_m \cdot f_m[(n-1)T] + q_m \cdot f_m[(n-2)T] \}$$

It should be understood that Eq. 3 will provide three different types of partials of a waveshape as follows:

first type:

$$f_m(nT) = D \cdot a_1^n + E \cdot a_2^n, \text{ for } p_m^2 + 4q_m > 0 \qquad \text{(Eq. 5)}$$

$$\text{where } a_1 = \frac{p_m + p_m^2 + 4q_m}{2} \text{ and}$$

$$a_2 = \frac{p_m - p_m^2 - 4q_m}{2}$$

second type:

$$f_m(nT) = D \cdot b^n + E \cdot m \cdot b^n, \text{ for } p_m^2 + 4q_m = 0 \qquad \text{(Eq. 6)}$$

$$\text{where } b = \frac{p_m}{2}$$

third type:

$$f_m(nT) = D \cdot e^{\alpha n} \cdot \text{Cos}(\omega n) + E \cdot e^{\alpha n} \cdot \text{Sin}(\omega n), \text{ for } p_m^2 + 4q_m < 0 \qquad \text{(Eq. 7)}$$

$$\text{where } \alpha = \text{Log}_e(-q_m), \qquad \text{(Eq. 8)}$$

$$\text{and } \omega = \text{Cos}^{-1} \frac{p_m}{2\sqrt{-q_m}} \qquad \text{(Eq. 9)}$$

In Eqs. 7, 8 and 9, D and E are constants dependent upon the initial conditions set for the starting of the calculation of the sample point amplitude of each partial according to these equations i.e. $f_m(0T)$ and $f_m(1T)$.

Figure 7:
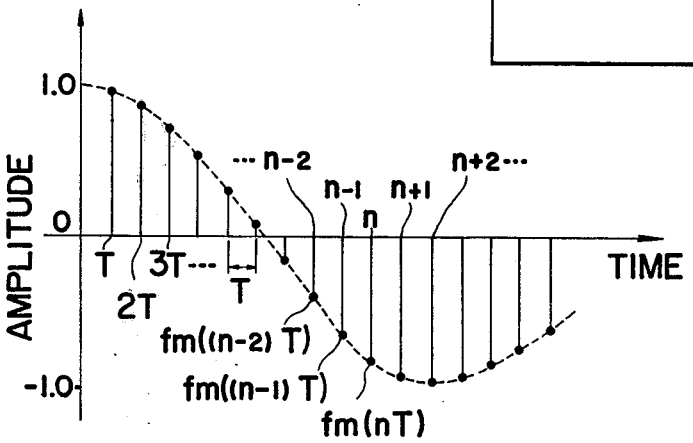
FIG. 7 is a chart showing an example of a partial of a musical tone obtained in accordance with an aspect of the present invention.

For instance, if T=100μS, $p_m=1.9371$, $q_m=-0.99997$, $f_m(0T)=1.0$ and $f_m(T)=0.96858$, there can be obtained a partial waveshape shown in FIG. 7.

Figure 8:
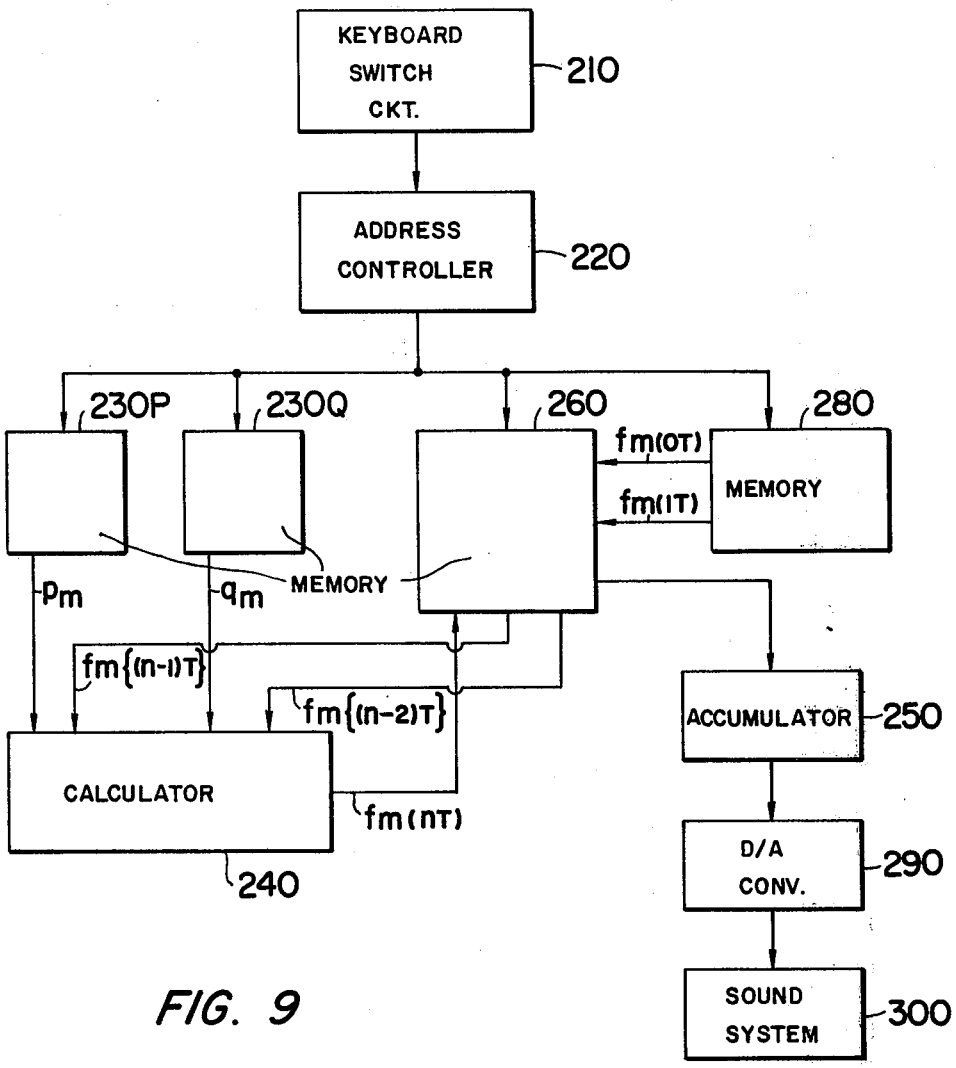
FIG. 8 is a block diagram showing another example of the general arrangement of a musical instrument embodying the present invention.

FIG. 8 shows a simplified block of an electronic musical instrument which is designed to calculate the amplitudes of the successive sample points of a complex waveshape aimed in accordance with Eqs. 3 and 4. This instrument is composed of: a keyboard switch circuit 210; an address controller 220; memories 230P and 230Q storing weighting coefficients $p_m$ and $q_m$, respectively; a calculator 240 for performing the algorithm of Eq. 3 to obtain $f_m(nT)$; a memory 260 for temporarily storing either the amplitude $f_m(nT)$ of the partials at the preceding sample point calculated by the calculator 240 or the initial conditions read out from a memory 280 storing the initial conditions; an accumulator 250 for accumulating the calculated amplitudes of partials to obtain the complex amplitude F(nT) for each sample point; and a digital-to-analog converter 290 for converting the successive amplitudes F(nT) in digital form from the accumulator 250 to an analog voltage as the input to a sound system 300. In this system, successive sample point amplitudes F(nT) of an aimed waveshape are generated at each clock pulse CK1 of FIG. 9 generated, at a regular time interval T, by a timing circuit not shown, and the calculations of the successive sample point partial amplitudes are implemented at each clock pulse CK2 generated at a regular time interval $\tau = T/M$, by the timing circuit.

The operation of the system of FIG. 8 is performed as follows. Upon closing one of keyboard switches 210, the initial conditions $f_1(0T)$, $f_1(1T)$; $f_2(0T)$; $f_2(1T)$; . . ., $f_M(0T)$, $f_M(1T)$ all corresponding to the closed keyboard switch are read out from the memory 280, under the control of the address controller 220, at each clock pulse CK2 to be stored in the memory 260. The accumulator 250 accumulates the initial conditions $f_m(0T)$ derived at each clock pulse CK2 the memory 260 to obtain the first amplitude $$F(0T) = \sum_{m=1}^{M} f_m(0T).$$

On the other hand, the calculator 240 receives both the initial conditions $f_m(0T)$ and $f_m(1T)$ and the weighting coefficients $p_m$ and $q_m$ derived, at each clock pulse CK2, from the memories 230P and 230Q under the control of the address controller 220 and thereby calculates the amplitudes $f_m(2T)$ of the partials in accordance with Eq. 3, and the calculated amplitudes $f_m(2T)$, in turn, are stored in the memory 260. At the beginning of the next calculation cycle, i.e. at the next clock pulse CK1, the first amplitude F(0T) is delivered from the accumulator 250 to the digital-to-analog converter 290. At the same time therewith, the initial conditions $f_m(1T)$ begin to be delivered, at each clock pulse CK2 from the memory 260, to the accumulator 250 in order to obtain the next amplitude $$F(1T) = \sum_{m=1}^{M} f_m(1T,$$

and also the calculator 240 begins to execute the calculation of the amplitude $f_m(3T)$, receiving both the weighting coefficients $p_m$ and $q_m$ and the amplitudes $f_m(1T)$ and $f_m(2T)$ stored in the memory 260. As such, the successive sample point amplitudes $f_m(nT)$ of the partials are calculated by the calculators 240, and these partial amplitudes $f_m(nT)$ are accumulated by the accumulator 250 to obtain the successive amplitudes F(nT) which, in turn, are converted by the digital-to-analog converter 290 to analog voltages as the input of the sound system 300. Thus, the aimed musical sound is produced by the sound system 300.

As described previously, in the system of FIG. 8, the calculations of the successive amplitudes of the partials are carried out on the time division basis under the timing control of clocks CK1 and CK2. It should be noted, however, that the amplitudes of all the partials may be calculated at a time.

Figure 9:
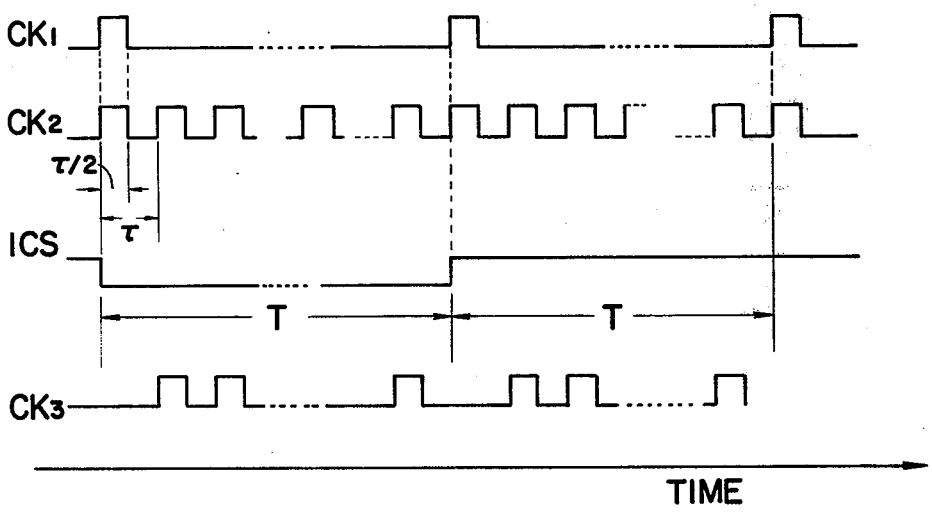
FIG. 9 is a timing diagram associated with the musical instrument of FIG. 8.
Figure 10:
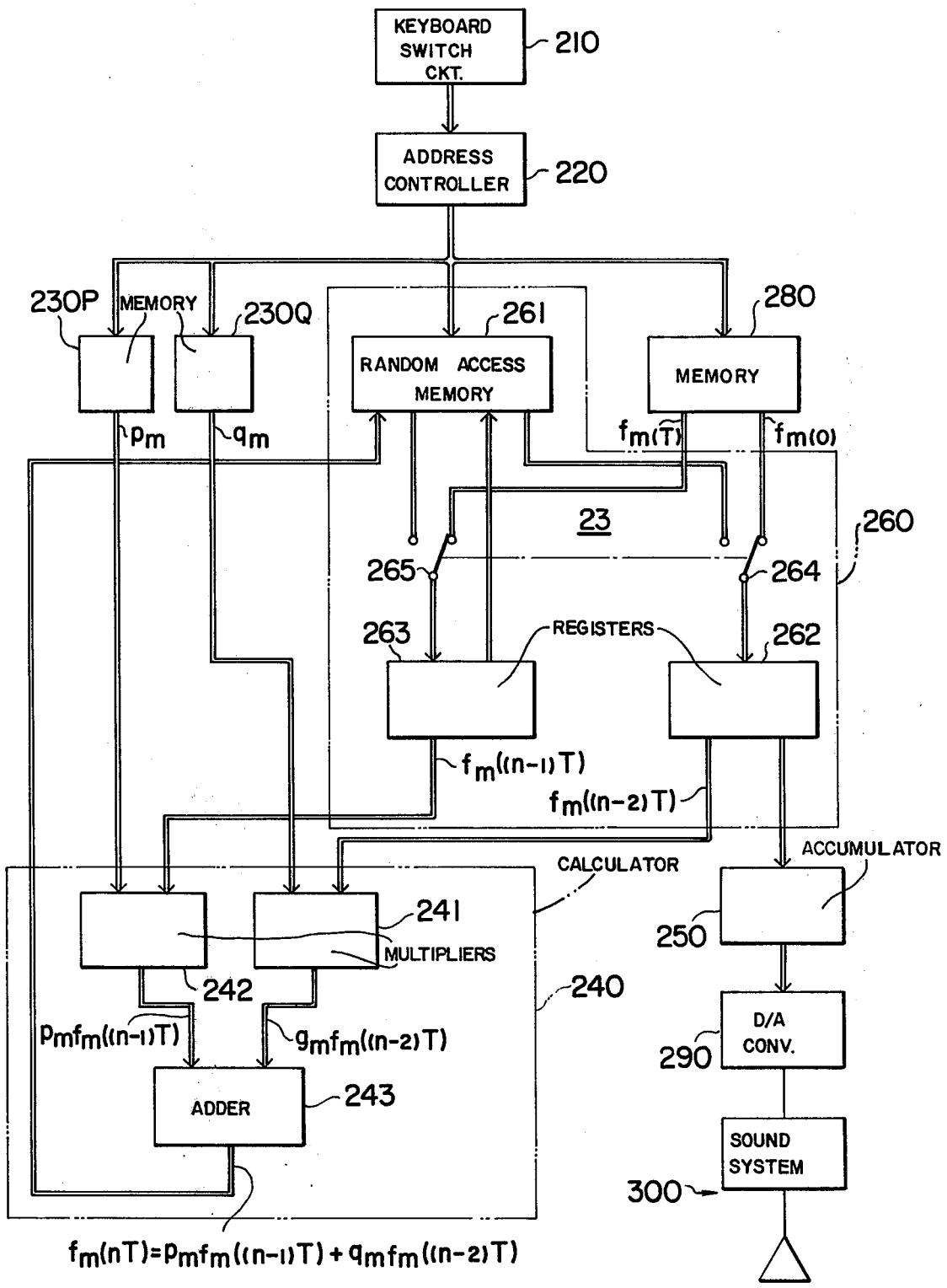
FIGS. 10 and 11 are block diagrams showing examples of more concrete arrangements of the musical instrument of FIG. 8.

In FIG. 10 is shown a more concrete arrangement of the system shown by FIG. 8, wherein the memory 260 is composed of a random access memory 261, registers 262 and 263, and switches 264 and 265; and the calculator 240 is comprised of multipliers 241 and 242, and an adder 243. The switches 264 and 265 are actuated by a signal ICS of FIG. 9, which is generated during the first calculation period T after closing one of the keyboard switches 210, to couple the memory 280 and the respective registers 262 and 263 to each other so that the initial conditions $f_m(0T)$ and $f_m(1T)$ which are read out from the memory 280 can be fed to the registers 262 and 263, respectively. The register 262 delivers, at each clock pulse CK2, the initial conditions $f_1(0T)$, $f_2(0T)$, . . ., $f_M(0T)$ in this order to both the accumulator 250 and the multiplier 241 of the calculator 240. The register 263, on the other hand, delivers the received initial conditions $f_1(1T)$, $f_2(1T)$, . . ., $f_M(1T)$ in this order at each clock pulse CK2 to both the memory 261 and the multiplier 242. The respective multipliers 241 and 242 multiply the received initial conditions $f_m(0T)$ and $f_m(1T)$ by the weighting coefficients $p_m$ and $q_m$ each being derived from the memories 230P and 230Q, respectively. The resultant products $p_m f_m(0T)$ and $q_m f_m(1T)$ are algebraically summed by the adder 243 to obtain the successive amplitudes $f_m(2T)$ of the partials, these amplitudes $f_m(2T)$ for $m = 1, 2, \ldots, M$ being successively stored in the memory. Thus, at the end of the first calculation period T, the amplitude F(0T) and F(2T) are obtained in the accumulator 250 and the memory 261, respectively.

At the beginning of the next calculation period, i.e. upon the next clock pulse CK1 being generated, the amplitude F(0T) is fed from the accumulator 250 to the digital-to-analog converter 290. Simultaneously, the initial conditions $f_m(1T)$ and the amplitudes $f_m(2T)$, each being stored in the memory 261, are placed into the registers 262 and 263 via the switches 264 and 265 which are now turned to the left positions in FIG. 10 because of the absence of signal ICS, respectively. The contents $f_m(1T)$ and $f_m(2T)$ of the respective registers 262 and 263 are placed, at each clock pulse CK2, into the multipliers 241 and 242 of the calculator 240 to calculate the amplitudes $f_m(3T)$ of the partials, respectively, and the contents $f_m(1T)$ of the register 262 are also placed into the accumulator 250 to obtain the amplitude F(1T).

The routine as described above is repeated so long as any one of the keyboard switches 210 is closed so that the successive sample point amplitudes F(nT) are applied to the digital-to-analog converter 290, thus being converted to analog voltages which are used as the input of the sound system 300. Thus, the aimed musical sound or note corresponding to the closed keyboard switch is produced from the sound system 300.

It should be noted that, in the system shown in FIG. 10, there can also be obtained the touch-response and/or after-control effects by varying the initial conditions and the weighting coefficients in accordance with depressing manner of the key, as described previously.

Figure 11:
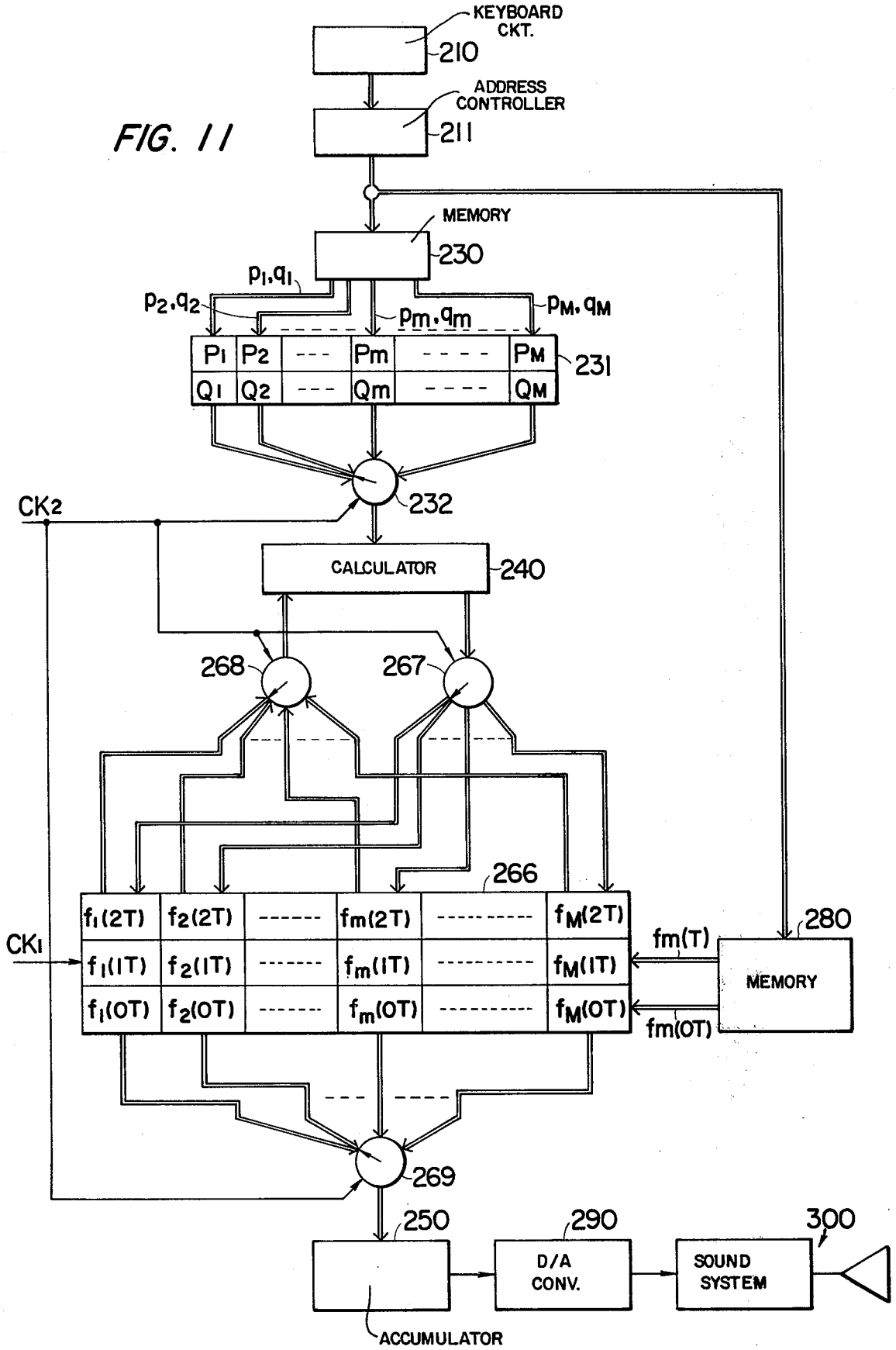

In FIG. 11 is shown another example of an electronic musical instrument wherein the calculation of the successive sample point amplitudes is implemented in a manner similar to that of the system of FIG. 10.

In this example, the weighting coefficients $p_m$ and $q_m$ are accessed at a time, under the control of the address controller 211, from the memory 230 to be placed, in parallel, into a two-stage M-word parallel shift register 231. The initial conditions $f_m(0T)$ and $f_m(1T)$ which are read out from the memory 280 under the control of the address controller 211 are placed into the third and second stages of a three-stage M-word parallel shift register 266. During the first calculation period, the contents $f_1(0T)$, $f_2(0T)$, . . ., $f_M(0T)$ of the third stage of the register 266 are retrieved, in this order, by a multiplexer 269 scanning the third stage synchronously with the clock pulse CK2, and these retrieved initial conditions, in turn, are accumulated at the accumulator 250 to obtain the complex amplitude F(0T). On the other hand, the calculator 240 receives both the initial conditions $f_m(0T)$ and $f_m(1T)$ from the register 266 and the weighting coefficients $p_m$ and $q_m$ from the register 231, through multiplexers 268 and 231 scanning the respective registers 266 and 231 in synchronism with the clock pulse CK2 to perform the calculation of the amplitudes $f_m(2T)$ of the partials. The calculated amplitudes $f_m(2T)$ are placed, through a multiplexer 267 scanning the register 266 synchronously with the clock pulse CK2, into the first stage of the register 266, at the end of the calculation period. Thus, the contents of the respective stages of the register 266 are as shown in FIG. 11.

Upon the clock pulse CK1 being generated at the beginning of the next calculation period, the contents of the respective stages of the register 266 are shifted one position downwardly so that the contents of the third stage, i.e. the initial conditions $f_m(1T)$ are fed through the multiplexer 269 to the accumulator 250 to obtain the amplitude F(1T) and that the contents of both the third and second stages are fed through the multiplexer 268 to the calculator 240 for calculating the amplitudes $f_m(3T)$. The calculated amplitudes $f_m(3T)$ are fed through the multiplexer 267 to the register 266 to be stored in the first stage of the register 266.

By repeating such routine as that mentioned above, the ampitudes F(nT) for the successive sample points are obtained at the accumulator 250, and these amplitudes are converted to analog voltages as the input of the sound system 300 so that the aimed musical sound is produced from the sound system 300.

In accordance with still another aspect of the present invention, the respective weighting coefficients $p_m$ and $q_m$ are calculated according to the following equations:

$$p_m = 2 \times \lambda_m \times \kappa_m \quad \text{(Eq. 10)}$$

$$q_m = -\kappa_m^2 \quad \text{(Eq. 11)}$$

where $\kappa_m$ represents factors determined with respect to a waveshape which is aimed to be generated. By substituting these equations to Eqs. 8 and 9, $\alpha$(attenuation constant) in Eq. 8 and $\omega$(angular frequency) in FIG. 9 are represented as follows:

$$\alpha = \frac{1}{2} \text{Log}\, \kappa_m^2 = \text{Log}\, \kappa_m \quad \text{(Eq. 12)}$$

$$\omega = \text{Cos}^{-1} \frac{2 \cdot \lambda_m \cdot \kappa_m}{2\sqrt{\kappa_m^2}} \text{Cos}^{-1} \lambda_m \quad \text{(Eq. 13)}$$

These equations show that $\alpha$ is dependent only upon the factor $\kappa_m$, and $\omega$ only upon the factor $\lambda_m$; in other words, the equations show that it is possible to determine $\alpha$ and $\omega$ independently of each other by the factors $\lambda_m$ and $\kappa_m$.

Figure 12:
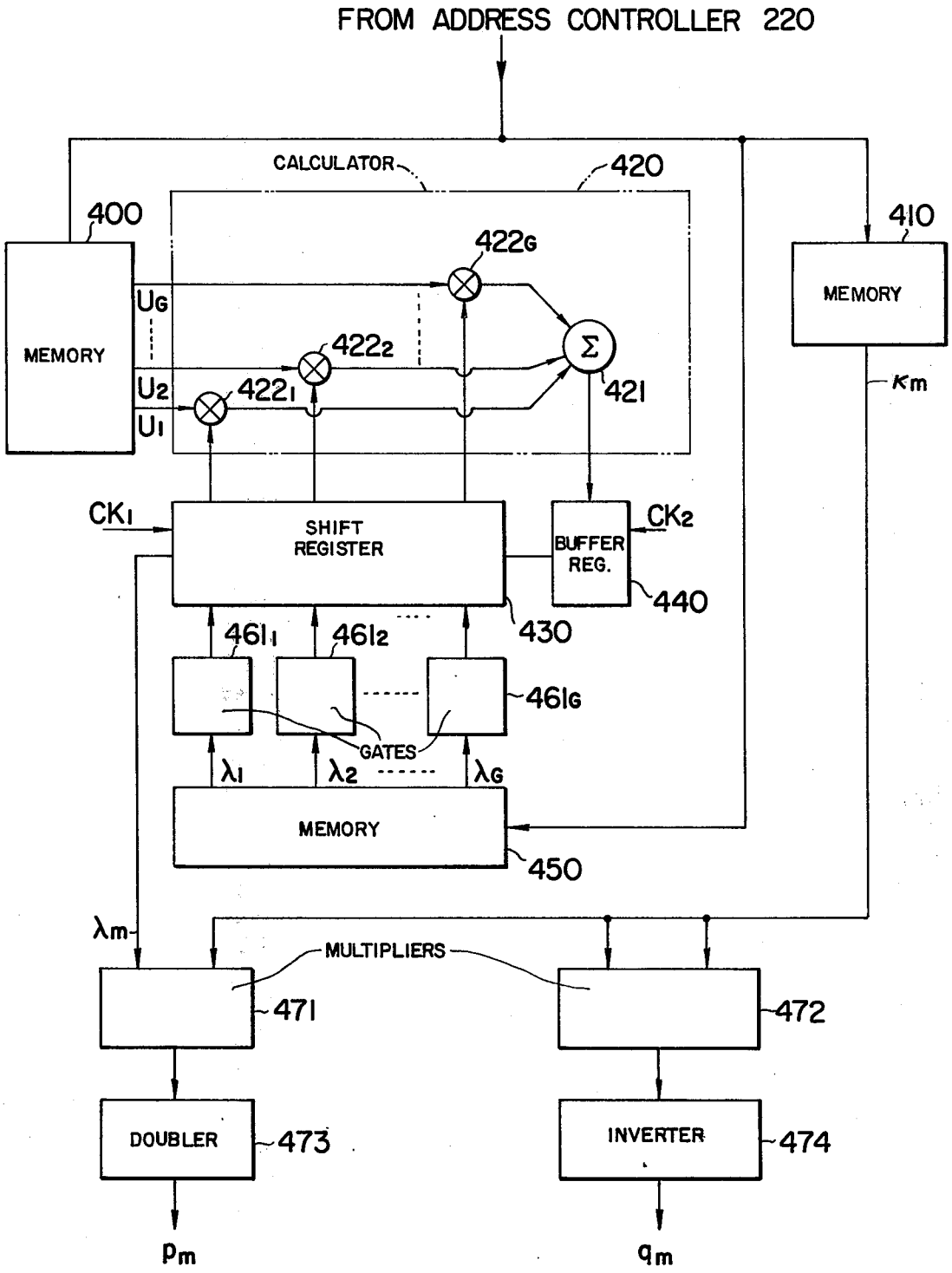
FIG. 12 is a block diagram showing an example of arrangement of means for generating the parameters to be used for amplitude calculation in the musical instrument of FIGS. 10 and 11.

In FIG. 12 is shown a system for implementing the calculations of $p_m$ and $q_m$ according to Eqs. 10 and 11, and this system provides an excellent advantage as will be explained below. The system of FIG. 12 includes: a memory 410 storing the factors $\lambda_m$ (m=1, 2, 3, . . ., M); a memory 450 sotring the factors $\lambda_1, \lambda_2, \ldots, \lambda_G$ (G << M); gates $\mathbf{461}_1, \mathbf{461}_2, \ldots, \mathbf{461}_G$; a G-stage shift register 430; a buffer register 440; a calculator 420 consisting of multipliers $\mathbf{422}_1, \mathbf{422}_2, \ldots, \mathbf{422}_G$ and an adder 421; a memory 400 storing auxiliary parameters $U_1, U_2, \ldots, U_G$; multipliers 471 and 472; a doubler 473; and an inverter 474. By this system, the remaining factors $\lambda_{G+1}, \lambda_{G+2}, \ldots, \lambda_M$ are calculated by the calculator 420 in accordance with a recurrent algorithm as will be described below, so that, if G << M, the whole storage capacity required for both memories 400 and 450 can be considerably decreased as compared with the case wherein the memory 450 is designed to store all the factors $\lambda_1, \lambda_2, \ldots, \lambda_M$.

The operation of the system is explained hereunder. Upon closing one of the keyboard switches, the factors $\kappa_1, \kappa_2, \ldots, \kappa_M$ are accessed and read out from the memory 410 under the control of the address controller 220, and the read-out factors $\kappa_1, \kappa_2, \ldots, \kappa_M$ are applied synchronously with the clock pulse CK2 to the multiplier 472 to be squared. The squared value $\kappa_m^2$ (m=1, 2, . . ., M) are then phase-inverted through the inverter 474, and as a result, the weighting coefficients $q_m = -\kappa_m^2$ are obtained at the output of the inverter 474.

While, the factors $\lambda_1, \lambda_2, \ldots, \lambda_G$ and the parameters $U_1, U_2, \ldots, U_J$ are retrieved from the memories 400 and 450 under the control of the address controller 220. The gates $\mathbf{461}_1, \mathbf{461}_2, \ldots, \mathbf{461}_G$ are enabled by a control signal which is generated by a timing circuit not shown immediately after closing the keyboard switch so that the factors $\lambda_1, \lambda_2, \ldots, \lambda_G$ are placed, through the enabled gates $\mathbf{461}_1, \mathbf{461}_2, \ldots, \mathbf{461}_G$, into the shift register 430. The calculator 420 carries out the following algorithm of Eq. 14, using both the parameters $U_g$ (g=1, 2, . . ., G) from the memory 400 and the contents of the shift register 430, to obtain the remaining factors $\lambda_{G+1}, \lambda_{G+2}, \ldots, \lambda_M$.

$$\lambda_{G+1} = \sum_{g+1}^{G} U_g \cdot \lambda_g \quad \text{(Eq. 14)}$$

$$\lambda_{G+2} = \sum_{g=2}^{G} U_g \cdot \lambda_{g+1}$$

$$\lambda_{G+3} = \sum_{g=1}^{G} U_g \cdot \lambda_{g+2}$$

$$\vdots$$

Needless to say, the respective contents of the shift register 430 are shifted, at each clock pulse CK2, one position to the left, so that the factors $\lambda_1, \lambda_2, \ldots, \lambda_G, \ldots, \lambda_M$ are applied, in this order in synchronism with the clock pulse CK2, to the multiplier 471 which is simultaneously applied with other factors $\lambda_1, \lambda_2, \ldots, \lambda_M$ from the memory 410. These factors $\lambda_m$ and $\kappa_m$ are mutually multiplied at the multiplier 471, and the resultant products are then doubled by the doubler 473, and thus the weighting coefficients $p_m$ are obtaiend at the output of the doubler 473.

It should be noted that the factors $\kappa_m$ may also be obtaine by such a recursive algorithm as for the factors $\lambda_m$.

An improved method of generating either the weighting coefficients $p_m$ and $q_m$ or the factors $\kappa_m$ and $\lambda_m$ will hereunder be explained with reference to FIG. 13.

Figure 13:
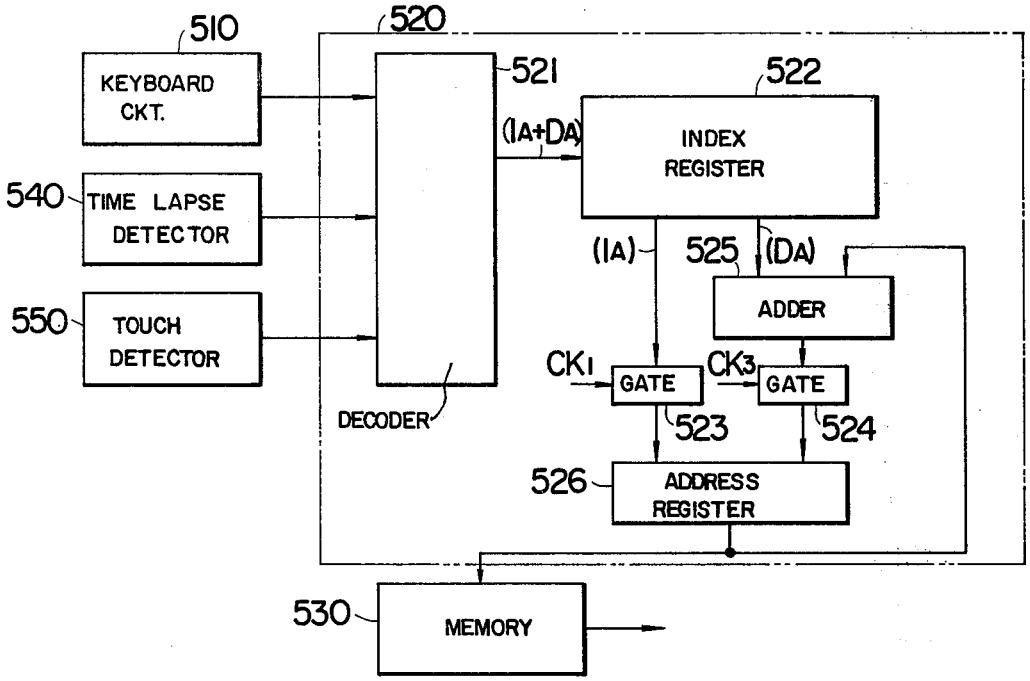
FIG. 13 is a block diagram showing another example of arrangement of means for generating the parameters to be used for amplitude calculation in the musical instrument of FIGS. 10 and 11.

In FIG. 13, a decoder 521 of the address controller 520 is inputted with the respective outputs of a keyboard switch circuit 510, a time-lapse detector 540 and a touch detector 550, to thereby deliver an indexing signal. The keyboard switch circuit 510 is adapted to output a signal signifying the depressed key, and the time-lapse detector 540 functions to generate a signal representing the time lapse from the time the key has been depressed. The touch detector 550 detects the strength of the touch of the player's finger onto the key, to thereby generate a signal corresponding to the detected touch strength. The indexing signal from the decoder 521 includes an initial-address signal $I_A$ corresponding to the depressed key number and an address-increment signal $D_A$ dependent upon the signals supplied from both two detectors 540 and 550, these signals $I_A$ and $D_A$ being stored in an index register 522 in the address controller 520. This address controller 520 further includes gates 523 and 524, an adder 525 and an address register 526. The gate 523 is enabled by the clock pulse CK1 shown in FIG. 9 to pass therethrough the initial-address signal $I_A$ from the index register 522 to the address register 526. The adder 525 performs the addition of the output of the address register 526 and the address-increment signal $D_A$ from the index register 522, the result of the addition being inputted, through the gate 524 which is enabled by a clock pulse CK3 shown in FIG. 9, to the address register 526. Thus, the content or output of the address register 526 changes as follows, with the passage of time t.

| Time | Content or output |
|---|---|
| 0 | $I_A$ |
| $\tau$ | $I_A + D_A$ |
| $2\tau$ | $I_A + 2D_A$ |
| . | . |
| . | . |
| . | . |
| $(M-1)\tau$ | $I_A + (M-1)D_A$ |
| $M\tau = T$ | $I_A + MD_A$ |
| . | . |
| . | . |
| . | . |
| $2T - \tau$ | $I_A + (2M-1)D_A$ |

The output of the address register 526 is applied, as the address information, to the memory 530 storing either the factors $\kappa_m$ or $\lambda_m$ or the weighting coefficients $p_m$ or $q_m$ at the specific address thereof. Since the address information supplied from the address register 526 is dependent upon the outputs of the detectors 540 and 550 as well as upon the output of the keyboard switch circuit 510, there can be read out from the memory 530 parameters having the values which are controlled, in various manners, according to the outputs of the detector 540 and 550. In other words, even if a limited capacity memory device is used as the memory 530, the parameters of the values varying in complex manners with respect to time can be obtained so that a sound varying, in amplitude and tone color, in complex manner with time passage can be produced, and also the values of the obtained parameters can be controlled according to the key touch strength so that the touch response effects are available without providing any additional means therefor. It should be noted accordingly that an application of the above system to the musical instrument shown in FIGS. 8, 10, 11 and 12 will provide the advantage that a relatively small capacity memory is usable for the respective memories 230, 230P, 230Q and 410 without deteriorating the performance of the instruments.

Let us now assume that the memory 530 has the storage configuration as shown in the following table.

| Address | Stored parameters |
|---|---|
| 0 | 70 |

-continued

| Address | Stored parameters |
|---|---|
| 1 | 75 |
| 2 | 80 |
| 3 | 85 |
| 4 | 90 |
| 5 | 95 |
| 6 | 100 |
| 7 | 99 |
| 8 | 98 |
| 9 | 97 |
| . | . |
| . | . |
| . | . |
| . | . |
| . | . |
| 56 | 50 |
| 57 | 49 |
| 58 | 48 |
| . | . |
| . | . |
| . | . |
| . | . |
| . | . |
| 104 | 2 |
| 105 | 1 |
| 106 | 0 |

Figure 14:
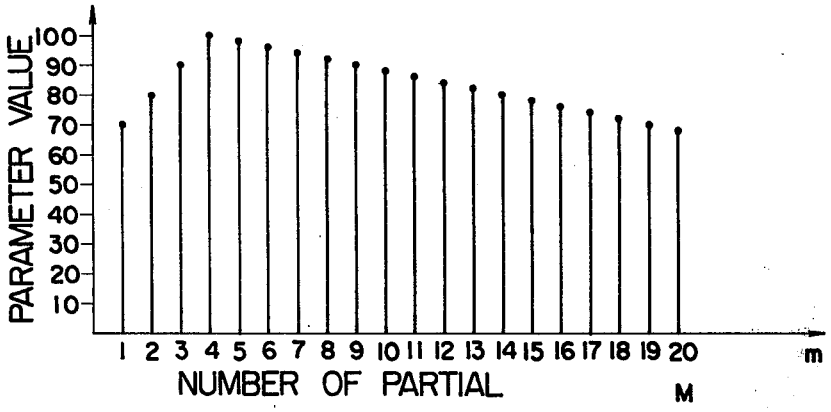
FIGS. 14 and 15 are charts showing example of parameters generated by the means of FIG. 13.
Figure 15:
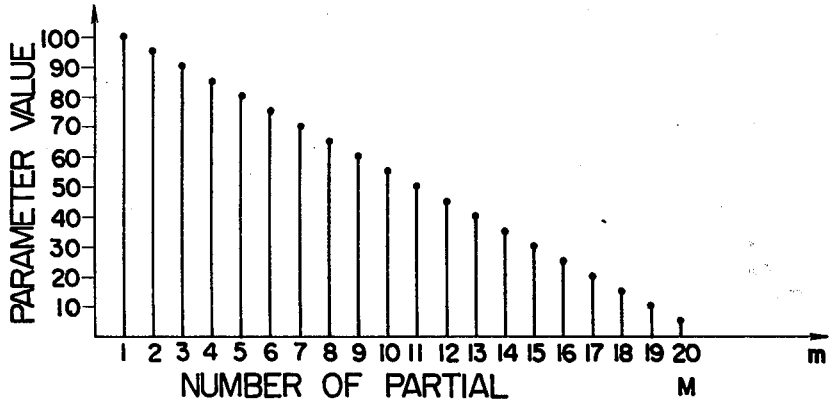

Providing that m=1, 2, . . ., 20; initial address $I_A=0$; and address increment $D_A=2$, there are generated, from the memory 530, the parameters as shown in FIG. 14. Alternatively, if m=1, 2, . . ., 20; initial address $I_A=6$; and address increment $D_A=5$, the parameters as shown in FIG. 15 are retrieved from the memory 530.

The above descriptions have be made with respect to monophonic electronic musical instruments which can produce only one musical note at a time. It should be understood, however, that there can be provided, according to the present invention, a polyphonic electronic musical instrument which is capable of producing two or more musical notes at a time. The polyphonic electronic musical instrument may have an arrangement wherein the amplitudes associated with two or more selected tones are first computed independently on a time-shared basis, and then they are combined to provide an input to the digital-to-analog converter. Such techniques should be apparent to those skilled in the art, and therefore their further explanation is omitted here.

We claim:

1. A musical instrument comprising:

a first means for calculating the amplitudes at successive sample points of a waveshape according to a recursive algorithm, using, at least for some sample points, the amplitudes at a plurality of the preceding calculated sample points to determine the values of said successive sample points according to the same identical formula for each calculation;

a second means for temporarily storing said preceding amplitudes; and a third means for converting said successive sample point amplitudes calculated by said first means to a musical tone corresponding to said waveshape.

2. A musical instrument according to claim 1, in which said first means includes: means for generating weighting coefficients; means for multiplying said preceding sample point amplitudes provided by said second means, by said weighting coefficients, respectively; and means for algebraically summing each of the resulting products of said respective preceding sample points amplitudes and said corresponding weighting coefficients to thereby obtain said successive sample point amplitudes.

3. A musical instrument according to claim 1, in which said calculating by said first means is performed digitally, and in which said third means includes: means for converting said successive sample point amplitudes of a digital form to analog amplitudes; and means for receiving said analog amplitudes to thereby produce said musical tone.

4. A musical instrument according to claim 1, further comprising a fourth means for providing initial conditions to said first means, said first means calculating the amplitudes at several early sample points, using said initial conditions as said preceding sample point amplitudes.

5. A musical instrument comprising:

a first means for calculating the amplitude of each partial constituting a waveshape at successive sample points of this waveshape in accordance with a recursive algorithm, using the amplitudes of the respective partial at a plurality of the preceding sample point to determine said successive sample points according to the same identical formula for each calculation;

a second means for accumulating said amplitudes of the partials at each sample point to obtain the amplitude of said waveshape at the sample point thereof; and a third means for converting the successive amplitudes obtained by said second means to said musical tone corresponding to said waveshape.

6. A musical instrument according to claim 5, in which said first means includes: means for providing weighting coefficients corresponding to the respective partials; means for multiplying said amplitudes of the respective partials at the preceding sample points by said corresponding weighting coefficients, respectively; and means for algebraically summing each of the resulting products of said amplitudes of the partials at the respective preceding sample points and said corresponding weighting coefficients to thereby obtain said amplitudes of the respective partials at the successive sample points.

7. A musical instrument according to claim 5, in which said second means performs digitally the accumulation, and in which said third means includes: means for converting said amplitudes of a digital form to analog amplitudes; and means for receiving the analog amplitudes to thereby produce said musical tone.

8. A musical instrument according to claim 5, in which said calculating by said first means is performed digitally.

9. A musical instrument according to claim 5, in which said calculation of the amplitudes of the respective partials at each sample point is conducted on a time division basis.

10. A musical instrument according to claim 5, further comprising a fourth means for providing initial conditions to said first means, said first means calculating the amplitudes of the respective partials at several early sample points, using said initial conditions as said amplitudes of the partials at said preceding sample points.

11. A musical instrument comprising:

means for calculating at regular time intervals T the amplitudes F (nT) at successive sample points of a waveshape, where n is an integer incremented each time interval T for specifying the sample point nT, in accordance with the following recursive algorithm:

$$F(nT) = \sum_k a_k \cdot F[(n-k)T]$$

where k represents a plurality of consecutive or skipwise integers except zero, $a_k$ represents coefficients of the corresponding k, said means for calculating comprising:

a first memory storing said coefficients $a_k$;

a calculator for performing said recursive algorithm to obtain the amplitudes F (nT) at successive sample points nT, using said coefficients $a_k$ and the amplitudes F [(n−k) T ] calculated by this calculator at the preceding sample points (n−k)T; and a second memory for temporarily storing said preceding amplitudes F [(n−k)T] to be used for the implementation of said calculation by said calculator, and means responsive to said calculating means for providing musical tones from said calculated amplitudes F (nT).

12. A musical instrument according to claim 11, in which said calculator comprises:

a plurality of multipliers for multiplying said respective preceding amplitudes F[(n−k)T] provided by said second memory, by said corresponding coefficients $a_k$ provided by said first memory; and an adder for algebraically summing the products of said preceding amplitudes F[(n−k)T] and said coefficients $a_k$ obtained by said respective multipliers to obtain said amplitudes F(nT) at the successive sample points.

13. A musical instrument according to claim 11, in which said second memory comprises a multi-stage shift register which is designed to operate so that the contents of the respective stages of this shift register are shifted one position towards one end stage of the shift register each time an amplitude F(nT) calculated by said calculator is placed into the other end stage of the shift register, said preceding amplitudes F[(n−k)T] being the contents of the desired stages of said shift register.

14. A musical instrument according to claim 11, in which said k consists of consecutive integers 1 up to K, said second memory comprising a K-stage shift register which is designed so that the contents of the respective stages thereof are shifted one position towards the one end stage of the shift register each time that the amplitude F(nT) calculated by said calculator is placed into the other end stage of the shift register, said calculator comprising: multipliers of K number for multiplying the contents of the respective stages of said shift register by said corresponding coefficients $a_k$, and an adder for algebraically summing the resulted products $a_k \cdot F[(n-k)T]$ of those contents and coefficients to obtain said amplitude F(nT).

15. A musical instrument according to claim 11, in which said calculating by said calculator is performed digitally, and in which said means for providing comprises a digital to analog converter.

16. A musical instrument according to claim 11, further comprising a third memory storing initial conditions, said calculator performing the calculation for the amplitudes at several early sample points, using said initial conditions as said preceding amplitudes.

17. A musical instrument wherein a musical tone is produced by: calculating the amplitudes F(nT) at successive sample points of a wavesahpe in accordance with the following recursive algorithm $$F(nT) = \sum_k a_k F[(n-k)T]$$

wherein n is an integer incremented at each time interval T for specifying the sample point, k represents a set of plural consecutive or skipwise integers other than zero, $a_k$ represents a set of coefficients of the corresponding k; and converting said calculated amplitudes F(nT) to a musical tone, comprising:

a note selecting means for selecting the note to be produced by the musical instrument;

an address control means responsive to said note selecting means;

a first memory means storing plural sets of said coefficients $a_k$ each corresponding to respective notes available in the musical instrument, one set of the coefficients $a_k$ corresponding to the note selected by said note selecting means being accessed and read out from said first memory means by said address control means;

a calculator means for implementing said recursive algorithm to obtain the amplitude F(nT) at each sample point nT of the waveshape corresponding to the note selected by said note selecting means, receiving both said set of coefficients $a_k$ read out from said first memory means and the amplitudes F[(n−k)T] calculated by this calculator means at the plural preceding sample points (n−k)T;

a second memory means for temporarily storing the plural amplitudes calculated by said calculator means, these stored amplitudes therein being provided, as said preceding amplitudes F[(n−k)T], to said calculator means;

a third memory means storing plural sets of initial conditions each corresponding to the respective notes available in the musical instrument, one set of initial conditions corresponding to the selected note by said note selecting means being accessed and read out from said third memory means by said address control means to be read out;

a means for causing said read-out set of initial conditions to be placed into said second memory means prior to the beginning of the calculation of the amplitudes by said calculator means, said calculator means implementing the calculation of the amplitudes for several early sample points, using the set of initial conditions stored in said second memory means as said preceding amplitudes; and a converting means for converting said calculated amplitudes to the musical note selected by said note selecting means.

18. A musical instrument according to claim 17, in which said second memory means comprises a multistage shift register which is designed to operate so that the contents of the respective stages are shifted one position towards one end stage thereof each the amplitude F(nT) calculated by said calculator means is placed into the other end stage of this shift register, the any plural contents of the respective stages of said shift register being used as said preceding amplitudes, said set of initial conditions which is read out from said third memory means being placed, via said means for causing, into the respective stages of said shift register.

19. A musical instrument according to claim 17, in which said first, second and third memory means are digital devices wherein said coefficients, initial conditions and calculated amplitudes are stored in digital form, respectively; in which said calculator means functions digitally; and in which said converting means comprises a digital-to-analog converter.

20. A musical instrument according to claim 17, in which said note selecting means comprises a plurality of keyboard switches each operable with the corresponding keys which are to be operated by player's fingers.

21. A musical instrument according to claim 20, further comprising:

means for detecting the depression speed of the key which is depressed by the player's finger to thereby generate a signal associated with the derpression speed; and means for modulating the read-out set of initial conditions to be placed into said memory means, in correspondence with said signal.

22. a musical instrument according to claim 20, further comprising:

means for detecting both the depression speed of and the subsequent depression pressure on the key which is depressed by the player's finger to thereby generate a signal associated with both the depression speed and the subsequent depression pressure; and means for modulating the read-out set of coefficients to be applied to said calculator means, in correspondence with said signal.

23. A musical instrument wherein a musical tone is produced by:

calculating the amplitude $f_m(nT)$ of each partial constituting a waveshape at successive sample points of this waveshape in accordance with the following recursive algorithm, using the amplitudes of the corresponding partials at the nearest preceding two sample points $$f_m(nT) + p_m f_m[(n-1)T] + q_m f_m[(n-2)T]$$

where n is an integer incremented each time interval T for specifying the sample point, m represents a group of integers designating the respective partials, $p_m$ represents a set of coefficients of the corresponding m, $q_m$ represents a set of coefficients of the corresponding m;

accumulating the calculated amplitudes $f_m$ (nT) of the respective partials to obtain the net amplitudes F(nT) of said entire waveshape at each sample point of said waveshape; and converting said net amplitudes F(nT) to a musical note, comprising:

a note selecting means for selecting the note to be produced by the musical intstrument;

an address control means responsive to said note selecting means;

a first memory means storing plural sets of said coefficients $p_m$ and of said coefficients $q_m$ each corresponding to respective notes available in the musical instrument, one of which sets of both coefficeints $p_m$ and $q_m$ corresponding to the note selected by said note selecting means being accessed and read out from said first memory means, by said address control means;

a calculator means for implementing said recursive algorithm to obtain the amplitudes $f_m$ (nT) of the respective partials at each sample point of a waveshape corresponding to the selected note, receiving both said read-out set of coefficients $p_m$ and $q_m$ and the amplitudes of the respective partials at the nearest preceding two sample points;

a second memory means storing plural sets of initial conditions each corresponding to the respective notes available in the musical instrument, one of which sets of initial conditions corresponding to the note selected by said note selecting means being accessed and read-out from said second memory means by said address control means;

a third memory means for temporarily storing said plural amplitudes of the partials calculated by said calculator means and for temporarily storing said read-out set of initial conditions prior to the calculation of successive amplitudes of the partials being begun by said calculator means;

an accumulator means for accumulating the amplitudes of the respective partials calculated by said calculator means to thereby obtain the amplitude of the complex waveshape for each sample point; and a converting means for converting the successive amplitudes obtained by said accumulator means to the musical tone of the note selected by said note selecting means, said calculator means performing the calculation of the amplitudes at several early sample points, using the set of initial conditions stored in said third memory means as said preceding amplitudes.

24. A musical instrument according to claim 23, in which the amplitudes of the respective partials at each sample point are calculated, by said calculator means, on time division basis during the time intervals T between the respective sample points.

25. A musical instrument according to claim 23, in which said first, second and third memory means are digital devices wherein said coefficients $p_m$ and $q_m$, said initial conditions and said calculated amplitudes are stored in digital form, respectively; in which said calculator means and said accumulator means both function digitally; and in which said converting means includes a digital-to-analog converter.

26. In a musical instrument wherein a musical tone is produced by:

calculating the amplitudes $f_m$(nT) of each partials consituting a waveshape at successive sample points of that waveshape in accordance with the following recursive algorithm, using the amplitudes of the corresponding partials at the nearest preceding two sample points $$f_m(nT) = p_m \cdot f_m[(n-1)T] + q_m \cdot f_m[(n-2)T]$$

where n is an integer incremented each time-interval T for specifying the sample point, m represents a group of integers designating the respective partials, $p_m$ represents a set of coefficients of the corresponding m;

accumulating the calculated amplitudes $f_m$(nT) of the respective partials to obtain the net amplitudes F(nT) of said waveshape at each sample point of the waveshape; and converting said net amplitudes F(nT) to a musical note, the improvement comprising:

a first memory means storing a set of first parameters $\lambda_m$;

a second memory means storing a set of second parameters $\kappa_m$;

a first calculator means for calculating said coefficients $p_m$ in accordance with the following equation, using said first and second parameters $\lambda_m$, and $\kappa_m$ $$p_m = 2 \cdot \kappa_m \cdot \lambda_m,$$

and a second calculator means for calculating said coefficient $q_m$ in accordance with the following equation, using said second parameters $\kappa_m$ $$q_m = -\kappa_m^2.$$

27. In a musical instrument wherein a musical tone is produced by:

calculating the amplitudes $f_m$(nT) of each partial constituting a waveshape at successive sample points of that waveshape in accordance with the following recursive algorithm, using the amplitudes of the corresponding partials at the nearest preceding two sample points $$f_m(nT) = p_m \cdot f_m[(n-1)T] + q_m \cdot f_m[(n-2)T]$$

where n is an integer incremented each time interval T for specifying the sample point, m represents a group of integers 1, 2, . . ., M each designating the respective partials, $p_m$ represents a set of coefficients of the corresponding m;

accumulating the calculated amplitudes $f_m$(nT) of the respective partials to obtain the amplitudes F(nT) of said waveshape at each sample point of the waveshape and converting said amplitudes F(nT) to a musical note, the improvement comprising:

a first memory means storing a set of first parameters $\kappa_m$, for m = 1, 2, . . ., M;

a first calculator means for calculating said coefficients $q_m$ in accordance with the equation of $q_m = -\kappa_m^2$, using said parameters $\kappa_m$;

a second memory means storing a set of second parameters $U_g$, for g = 1, 2, 3, . . . , G < M;

a third memory means storing a set of third parameters $\lambda_g$;

a second calculator means for calculating the parameters $\lambda_m$, for m = G + 1, G + 2, . . . , M, in accordance with a recursive algorithm, using both said parameters $U_g$ and the contents of the respective stages of a G-stage shift register, said calculated parameters $\lambda_m$ being placed into one end stage of said register, the contents of the respective stages of said register being shifted one position toward the other end stage of the register each the calculated parameters $\lambda_m$ being placed into said one end stage, said third parameters being placed into the respective stages of said register prior to the beginning of calculation for the amplitudes of the partials at each sample point, the resultant parameters $\lambda_m$, for m = 1, 2, . . . , M being obtained as the contents of said other end stage of said register; and a third calculator means for calculating said coefficients $p_m$, for m = 1, 2, . . . , M, in accordance with the equation of $p_m = 2 \cdot \kappa_m \cdot \lambda_m$, using both said parameters $\kappa_m$ stored in said second memory means and said parameters $\lambda_m$ obtained in said one end stage of said register.

28. In a musical instrument of the type including generation means wherein a musical waveshape is produced by: computing the amplitude of the respective partials each constituting that waveshape at successive sample points of this waveshape; and accumulating the calculated amplitudes of the partials to obtain the amplitudes of that waveshape at each sample point; said amplitudes of the respective partials for each sample point being calculated on time division basis in accordance with a recursive algorithm, using the calculated amplitudes of the partials at a plurality of the preceding sample points and a set of coefficients for weighting those preceding amplitudes of the respective partials, the improvement comprising:

a memory having a plurality of storages at the individual addresses thereof;

means operative with keyboard having plural keys for generating a note number signal corresponding to one key depressed by the player's finger;

means for generating a touch signal associated with the depression strength of said depressed key;

means for generating a time lapse signal associated with the time lapse after the depression of the key;

means for generating a index signal including an initial address signal corresponding to said note number signal and an address increment signal related to both said touch signal and said time lapse signal;

one register for temporarily storing said index signal;

one gate being enabled at the beginning of the calculation for the amplitudes of the partials for each sample point to allow said initial address signal from said one register to be placed via that one gate into another register, said another register delivering out the content thereof each time the calculation of the amplitude of the respective partials is performed;

an adder for performing the addition of said address increment signal from said one register and the delivered content signal of said another register, the results of said addition being placed into said another register via another gate; said another gate being enabled each time the calculation of the amplitude of the respective partials is performed;

said content signals delivered out from said another register being used at said memory as the address information for specifying the address to be accessed; and the memory storages read out from said memory being used as said coefficients.

* * * * *

UNITED STATES PATENT AND TRADEMARK OFFICE

CERTIFICATE OF CORRECTION

PATENT NO. : 4,133,241

DATED : January 9, 1979

INVENTOR(S) : Koji NIIMI: Michiaki KUMAOKA & Takashi YAMADA

It is certified that error appears in the above-identified patent and that said Letters Patent are hereby corrected as shown below:

IN THE CLAIMS

Claim 23, column 16, line 45, change "+" first occurrence to -- = --.

Claim 26, Column 17, line 66, change ";" to --,-- and add --q represents a set of coefficients of the corresponding m;--

Claim 27, column 18, line 38, change ";" to --,-- and add -- q represents a set of coefficients of the corresponding m; --

Column 18, line 40, after "the" insert --net--

Column 18, line 43, after "said" insert --net--

Claim 28, column 20, line 3, change "a" to --an--

Signed and Sealed this

Fifth Day of May 1981

[SEAL]

Attest:

RENE D. TEGTMEYER

Attesting Officer

Acting Commissioner of Patents and Trademarks